US005755389A

United States Patent [19]

Miyasaki

[11] Patent Number: 5,755,389

[45] Date of Patent: May 26, 1998

[54] METHOD AND APPARATUS FOR RECOVERING THE FUEL VALUE OF CRUDE OIL SLUDGE

[76] Inventor: Mace T. Miyasaki, 6203 Blackburn La., Baltimore, Md. 21212

[21] Appl. No.: 822,611

[22] Filed: Mar. 19, 1997

Related U.S. Application Data

[62] Division of Ser. No. 553,900, Nov. 6, 1995, Pat. No. 5,653,865.

[51] Int. Cl.[6] ..... B02C 19/12

[52] U.S. Cl. ..... 241/91; 241/21; 241/101.74; 241/260.1; 241/152.2

[58] Field of Search ..... 15/340.1, 93.1; 208/426; 134/22.18, 40, 167 R; 241/21, 91, 24.1, 24.14, 95, 86.1, 101.8, 101.74, 101.742, 275, 260.1, 43, 152.2

[56] References Cited

U.S. PATENT DOCUMENTS

| | | | |
|---|---|---|---|
| 2,485,352 | 10/1949 | Bircher, Jr. et al. . | |
| 3,765,087 | 10/1973 | Pawloski . | |
| 4,014,780 | 3/1977 | McCoy . | |
| 4,144,162 | 3/1979 | Edgar et al. . | |
| 4,264,453 | 4/1981 | Mraovich . | |
| 4,604,007 | 8/1986 | Hall et al. . | |
| 4,618,735 | 10/1986 | Bridle et al. . | |
| 4,770,711 | 9/1988 | Deal, III et al. . | |
| 4,786,401 | 11/1988 | Jacob et al. . | |
| 4,819,525 | 4/1989 | Rabe . | |
| 4,842,715 | 6/1989 | Paspek, Jr. et al. . | |
| 4,885,079 | 12/1989 | Eppig et al. . | |
| 4,931,161 | 6/1990 | Sundar . | |
| 5,078,593 | 1/1992 | Schreiber, Jr. et al. . | |
| 5,078,799 | 1/1992 | Matter et al. . | |
| 5,122,193 | 6/1992 | Derlein . | |
| 5,154,831 | 10/1992 | Darian et al. . | |
| 5,218,767 | 6/1993 | Wells . | |
| 5,259,945 | 11/1993 | Johnson, Jr. . | |
| 5,269,234 | 12/1993 | Powell | 241/21 |
| 5,288,391 | 2/1994 | Biceroglu . | |
| 5,288,413 | 2/1994 | Chu . | |
| 5,328,105 | 7/1994 | Sims et al. . | |
| 5,335,395 | 8/1994 | Allen . | |
| 5,347,069 | 9/1994 | Sundar . | |
| 5,422,019 | 6/1995 | Carman . | |
| 5,495,986 | 3/1996 | Davenport | 241/21 |

FOREIGN PATENT DOCUMENTS

| | | |
|---|---|---|
| 619895 | 5/1961 | Canada . |

*Primary Examiner*—Mark Rosenbaum
*Attorney, Agent, or Firm*—Foley & Lardner

[57] ABSTRACT

A method and apparatus for converting crude oil tank bottoms to a liquid fuel, which uses a powered cutting tool to break up crude oil sludge contained in an oil storage tank bottom, with injection of cutter stock to facilitate break up of the sludge, an extraction pump to extract the sludge mixture comminution chamber and optional added cutter stock to reduce the particle size of solids to a uniform size range, to form a blend stock, which can be used to dilute a liquid fuel in an amount that will not adversely affect its product specification, whereby substantially all of the fuel value of the sludge is recovered.

13 Claims, 2 Drawing Sheets

METHOD AND APPARATUS FOR RECOVERING THE FUEL VALUE OF CRUDE OIL SLUDGE

This application is a divisional of application Ser. No. 08/553,900, filed Nov. 6, 1995 now U.S. Pat. No. 5,653,865.

BACKGROUND OF THE INVENTION

The present invention relates to recovering the fuel value from waste sludges and in particular to recovering and reclaiming the fuel value from crude oil tank bottoms.

There are numerous sources which produce organic hydrocarbon containing waste sludges as by-products. Due to environmental regulations and lack of landfill space, there is an increased desire to treat sludge waste products in the most economically feasible manner. Treatment methods which are acceptable for either reclaiming or disposing of hydrocarbon sludges vary depending on the chemical makeup of the sludge. U.S. Pat. No. 5,154,831 details the various components which are present in sludges from various sources.

A particular problem arises with removal and treatment of the sludge which accumulates on the bottom of crude oil storage tanks. Heavy crude oil often can contain as much as 3 to 5% of the crude oil volume in globular form. When this crude oil is put into storage tanks, the globular oil settles to the bottom of the tank. As successive loads of crude oil are transitioned through the tank, a thick layer of the settled globular oil accumulates in the bottom of the tank. This settled globular oil is commonly referred to as crude oil tank bottoms or crude oil sludge.

Most refineries periodically take the storage tanks out of service, cut a hole in the side of the tank, and remove the bottoms. Alternately the bottoms of the storage tanks can be removed using one of several known techniques utilizing chemicals or cutter stock. The residual solids are usually disposed of in a landfill or incinerated.

For example, U.S. Pat. No. 4,014,780 to McCoy teaches a distillation technique for treating refinery sludge so it is suitable for disposal in a landfill. Biceroglu, U.S. Pat. No. 5,288,391, teaches a process involving separating a sludge into two phases by distillation. U.S. Pat. No. 4,931,161 to Sundar teaches a process for solidifying a waste sludge by adding a binder. U.S. Pat. No. 5,288,413 to Chu discloses a process whereby a solid fuel is formed from a sludge wherein the waste sludge is filtered and dried. Sims et al., U.S. Pat. No. 5,328,105 discloses a transportable processing unit for treating organic wastes.

In spite of the prior art attempts, up to this point, there has not been an effective process for treating crude oil tank bottom sludge which employs a single apparatus which both removes the crude oil sludge from the storage tank, and performs subsequent processing of the removed sludge so that the fuel value contained in the sludge may be recovered.

SUMMARY OF THE INVENTION

One object of the invention is substantially complete recovery of the fuel value in crude oil tank bottoms, in the form of a liquid blend stock.

Another object of the invention is an apparatus or system, preferably one that is transportable on one or more flatbed trucks and/or trailers, that can be conveniently inserted into a crude oil tank and can pump out the sludge and process it to produce a liquid blend stock.

These and other objects are achieved by providing: a method for converting crude oil tank bottoms to a liquid fuel comprising subjecting crude oil sludge contained in an oil storage tank bottom to a powered cutting tool to break up the sludge, injecting and mixing cutter stock into the sludge volume being acted on by the cutting tool, if necessary, to facilitate break up of the sludge and form a sludge mixture, extracting the sludge mixture from the tank with an extraction pump, and comminuting the sludge mixture to reduce the size of sludge globules contained therein to produce a homogeneous mixture, optionally adding an additional quantity of cutter stock and/or other selected additives to the sludge mixture, either before, during or after comminution, to form a blend stock. Advantageously, a liquid fuel having a product specification is diluted with the blend stock in an amount that will not adversely affect the product specification of the liquid fuel, whereby substantially all of the fuel value of the sludge is recovered. By diluting a commercial fuel with a relatively small quantity of the processed blend stock, substantially all of the fuel value of the crude oil sludge is recovered while maintaining the standardized product specification of the liquid fuel.

The invention further provides an apparatus for recovering crude oil sludge contained in an oil storage tank bottom comprising: a mobile extraction unit capable of being inserted into the storage tank, the extraction unit comprising a tracked carriage, an extraction pump mounted on the tracked carriage, at least one powered cutting tool mounted on the tracked carriage in a position in front of the extraction pump, the auger cutting head being powered independently of the tracked carriage and the extraction pump, and at least one injector provided on the extraction unit adjacent the helical auger, the injector being capable of injecting a hydrocarbon containing cutter stock such that the cutter stock will act to entrain the crude oil sludge, forming a sludge mixture, a hose removably connected on a first end to the mobile extraction unit and adapted to accommodate and transport the sludge mixture recovered by the extraction unit from the storage tank, a comminution chamber in fluid communication with an opposite end of the hose and adapted to receive the sludge mixture which is transported by the hose, the comminution chamber including therein a means to reduce the size of sludge globules contained within the sludge mixture, and an outlet for a blend stock product. Advantageously, the apparatus will further comprise at least one diluent injection port which is connected to, and in fluid communication with the comminution chamber, the injection port being adapted to controllably inject a variable quantity of diluent into the sludge mixture so as to improve the flowability of the blend stock product.

DETAILED DESCRIPTION

Figure 1:
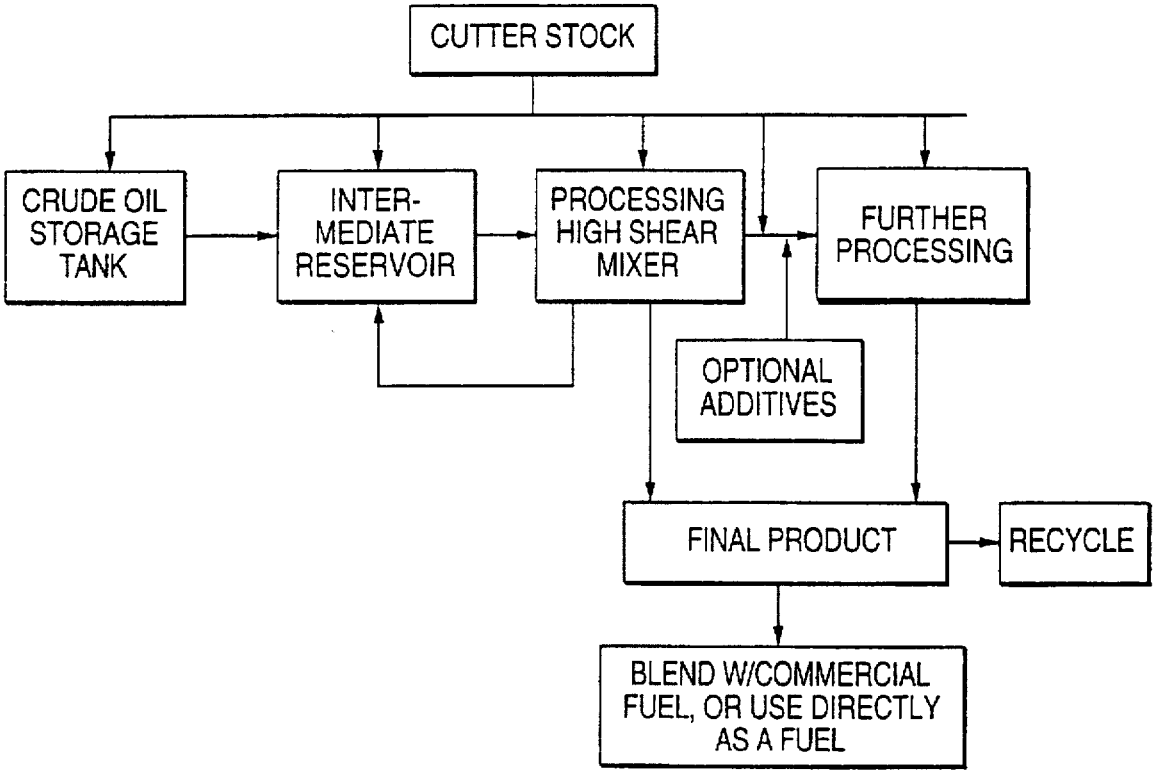
FIG. 1 is a schematic diagram showing the sludge treatment method of the present invention.
Figure 2:
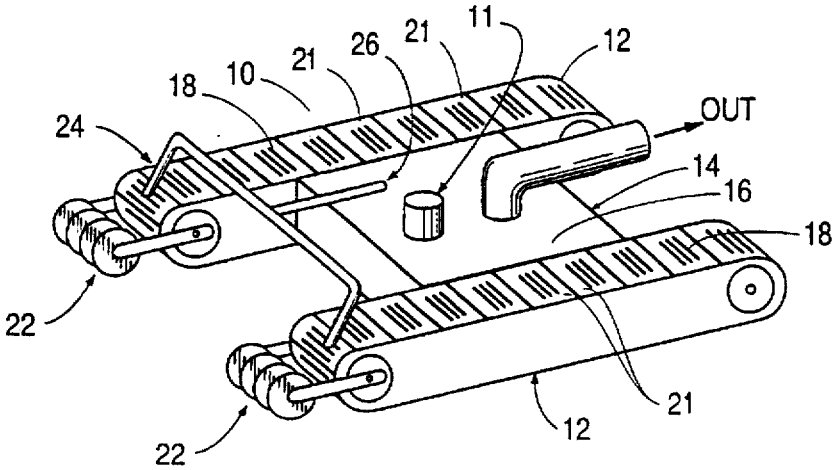
FIG. 2 is a sludge recovery unit of the present invention.
Figure 3:
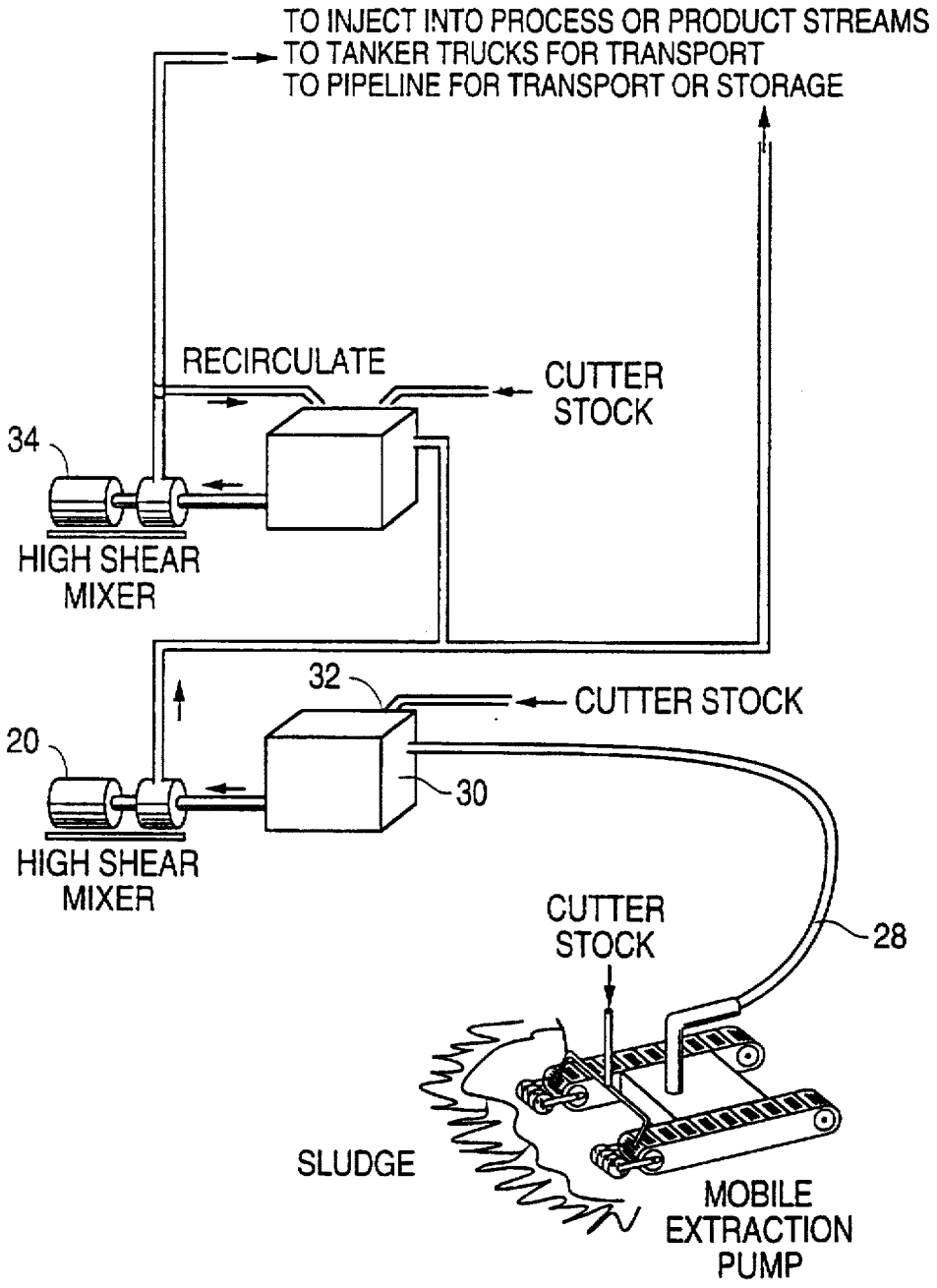
FIG. 3 is pictorial diagram of the extraction and processing system according to the present invention.

The apparatus of the present invention includes two component units; a mobile sludge recovery unit 10 and at least one processing unit 20. The mobile sludge recovery unit 10 is a self-contained apparatus which can be moved around a site or refinery to the location of crude oil storage tanks which contain solid tank bottom sludge sought to be recovered. The recovery unit 10 may include either electric or hydraulic power generators to power the components of the recovery unit.

The recovery unit 10 comprises an extraction pump 11 which is mounted between two continuous tracks 12 on a carriage 14. The pump 11 is preferably hydraulically activated and may be controlled remotely and/or manually. The sludge extraction pump 11 is preferably a centrifugal pump with a heavy impeller capable of pumping heavy material at rates as high as 300 gallons per minute. A heavy bar grid is preferably installed over the input of the pump 11 so that only particles smaller than ¾" can pass through. The pump rotor clearance is preferably ⅜", so only particles smaller than the clearance are pumped. Different size bar grids can also be installed with different size openings. A suitable extraction pump is the Trak Pump model manufactured by H&H Pump and Dredge Company of Holden, La.

The recovery unit 10, which is independently powered, preferably includes two continuous track assemblies 12 which have a platform 16 mounted therebetween. The track assemblies 12 are preferably about six inches in width and five feet in length. A track 18 is mounted to each track assembly 12. The tracks 18 are preferably formed of a plurality of sections 21 which are adapted to move continuously around the track assembly 12. The tracks 18 can be made of rubber, metals such as steel, coated metals, or any other suitable material such as stainless steel.

The recovery unit 10 is configured to be inserted into the interior of the oil storage tank. Most storage tanks include an access consisting of a 24" diameter flanged opening on the side of the tank, commonly referred to as a "manway".

The track assemblies 12 are preferably hinged to the platform 16 so they can be rotated downward 90 degrees by actuating a set of hydraulic cylinders (not shown) attached between the platform 16 and the track assemblies 12. This arrangement reduces the width of the recovery unit 10 allowing it to be inserted through the manway to the inside of the tank. After the recovery unit 10 is inside the tank, the hydraulic cylinders are again actuated and the track assemblies 12 are returned to their normal position for movement of the recovery unit 10 around the inside of the oil storage tank.

It is contemplated that at least one powered cutting tool 22, such as a helical auger, will be mounted on a front section of the recovery unit 10. In a preferred embodiment, one cutting tool or auger 22 is mounted in front of each continuous track assembly 12. This preferred arrangement will permit the augers 22 to break up the solid globular sludge and channel it into the pump intake.

It is preferable to have a separate hydraulic motor (not shown) powering the augers 22, so the mobile recovery unit 10 may be either stationary or mobile while the augers 22 are cutting into the sludge or mixing the sludge into a pumpable consistency. However, the augers may be powered by chains, which are in turn driven by the movement of the tracks through a gear train.

The recovery unit 10 additionally may be provided with at least one injector 24 which is in fluid communication with an inlet 26. The injector 24 serves to inject cutter stock directly into the storage tank. It is contemplated that the cutter stock injectors 24 are positioned such that the cutter stock is injected at a location in front of the recovery unit. In this way, the cutter stock will aid in loosening and removing the solid, globular crude oil sludge from the bottom of the storage tank. From inlet 26 an additional hose (not shown) may be connected, on the outside, to a separate pump (not shown) which pumps diluent from an exterior reservoir.

The cutter stock may be of any composition which is capable of being employed as a diluent, solvent or suspending agent for solid or semi-solid hydrocarbons such as globular sludge. The cutter stock is preferably a liquid hydrocarbon. Examples of suitable cutter stock compositions include #2 diesel fuel and #6 fuel oil.

As an alternative, a portion of the liquid sludge mixture either from the storage tank or from the processing operations which are downstream from the recovery unit may be recycled and used as a cutter stock. For instance, there may be a vacuum source (not shown) disposed on the recovery unit 10 which serves to withdraw a quantity of liquid into a holding tank. The liquid from the holding tank is then recycled to the injection ports 24 and injected back into the storage tank to aid in the loosening and removing of the solid sludge. In this way, a relatively small quantity of fresh cutter stock would be necessary as the liquid from the storage tank is continuously recycled and reused. As a further alternative, effluent from downstream processing operations of the sludge may be fed to the injectors of the recovery unit 10 and utilized as cutter stock.

Once inside the tank, positioning of the recovery unit 10 within the storage tank is preferably accomplished by energizing hydraulic motors (not shown) driving the tracks 18 to move the machine forward, reverse, or rotating it left or right. The hydraulic motors are preferably powered by pressurized hydraulic fluid fed from an external hydraulic pump and controls through hoses connected between the hydraulic pump and controls to the recovery unit 10. Position of the recovery unit 10 inside the tank may be monitored by a closed circuit TV system mounted at the manway. Alternatively, a closed circuit TV system could be mounted directly on the recovery unit, with any necessary accessory lighting mounted on the recovery unit or at the perimeter of the tank. It is contemplated that the monitoring unit is mounted in a position which is convenient to the operator controlling the operation of the recovery unit 10.

A control unit (not shown) can also be included to control operation of the extraction pump 11 which is located on the recovery unit 10. When the recovery unit 10 first enters the storage tank, the sludge often is globular and solidified to such a degree as to render it incapable of being extracted. However, after the auger 22 on the front of the carriage 14 has begun breaking up the solidified sludge and/or cutter stock has been injected into the tank, extraction by pumping is more easily accomplished. Consequently, it is desirable to include a means for controlling operation of the pump 11 from a remote location so that the extraction pump 11 may be activated at some point after insertion of the recovery unit 10 into the storage tank.

The control unit also can remotely activate a motor (not shown) which controls the cutting tools 22 mounted on the front of the carriage 14. In this way, it is possible to power the cutting tools 22 as needed, even when the recovery unit 10 is stationary. There may additionally be provided a means for remotely controlling the timing, quantity, and/or chemical make-up of the cutter stock. Alternatively, the recovery unit 10 may be preprogrammed to inject a particular cutter stock at particular timed intervals.

After extraction by the recovery unit 10, the recovered sludge, which now forms a liquid/solid suspension, is transferred out of the storage tank via a hose 28. The extracted sludge may, and preferably is, then be fed to an intermediate reservoir or tank 30. The intermediate reservoir 30 will hold the liquid sludge prior to further treatment operations. In addition, the intermediate reservoir may be provided with an inlet 32 for the addition of cutter stock and/or other additives. The inclusion of at least one intermediate reservoir 30 permits a continuous flow of material to a downstream processor 20. The reservoir 30 also may serve as a surge accumulator for material being pumped from the extraction pump 11. At times when the flow from the extraction pump 11 is low, processed material can be recirculated into the intermediate reservoir tank 30 to ensure material being available to the input of the processor 20. The intermediate reservoir 30 may be connected to the input side of the processing unit 20, and the bottom of the reservoir 30 may serve as a sump to divert any large particles from entering the processor 20.

The extracted sludge is then transferred, either from the intermediate reservoir or directly from the storage tank if no intermediate reservoir is included, to a high shear mixing processor 20 which is capable of blending, homogenizing, particle size reduction, and deagglomeration. All material extracted from the tank by recovery unit flows through the processor 20. The high shear mixer is a conventional apparatus known to those skilled in the art and includes a motor and an enclosed chamber with an inlet and an outlet. Within the chamber, a workhead is mounted on a spindle. The workhead preferably is removable and several different workheads which are interchangeable preferably will be provided with the processing unit to allow for selective processing capabilities. The workhead includes a stator about its outer periphery. The stator is provided with apertures or openings such that when the workhead is subjected to high speed rotation, any solid particles in the vicinity of the workhead will be forced through the openings or apertures, thus reducing the particle size of the solids. For example, one workhead may include a stator having large circular openings, while another workhead may include very small square apertures or screens. At the point where the workhead is mounted to the spindle, rotor blades are preferably provided to force the material being processed into the workhead and through the openings in the stator. The high speed rotation of the rotor blades within the workhead exerts a powerful suction, drawing liquid and solid materials into the rotors. Centrifugal force then drives materials towards the periphery of the workhead where they are subjected to a milling action. Hydraulic shear is then applied as the materials are forced, at high velocity, out through the perforations of the stator, then through the chamber outlet, exiting the mixing processor 20.

A preferred processing machine is a high shear mixing device such as a Silverson In-Line High Shear Mixer, LS Models, although a number of other machines are capable of similar actions such as those manufactured by Bematek Systems, Inc. of Beverly, Mass., Greerco Corp. of Hudson, N.H., and Kinematica, Inc., of Newton, Mass. to name a few. The processing machine may require a positive displacement pump provided upstream from the processor to ensure most efficient processing volumes. For example, a Moyno Progressing cavity Pump manufactured by Robbins & Myers Inc. may be employed if desired.

The processing machine inter alia, comminutes the mixture and as such, reduces the particle size of the solid globules which are contained within the extracted sludge. The ultimate particle size is dependent on the size of constituent components in the sludge, and is usually made of particles such as sand, minerals, or dirt. It is typical that, in crude oil, these particles are of the order of less than 30 microns in size, many being less than 20 microns in size.

Downstream from the high shear mixer, additional holding tanks and processors may be provided. For example, the material may be transferred to a supplemental tank where the sludge mixture is subjected to further high shear mixing to achieve an even finer average particle size which ranges from 10 to 20 microns. For example, the second processor 34 preferably has numerous holes in the stator, each of which is smaller in diameter than the holes provided in the previous processor stator. The breakdown of the solid globules into a small particle size is preferably accomplished by the use of successively finer high shear mixing stators. The determination of the nature and type of successively smaller stators is dependent upon the physical characteristics of the sludge globules and how readily the globules break down.

In addition, it is contemplated that the processors could be configured to allow variation in the processing operations and additives which are applied. That is, the system design can easily be adapted to allow recirculation, injection of additives and/or adjuvants at any point or location within the system, or allow for further processing operations. Thus, prior to setting up the recovery and processing equipment at each site, or even during a sludge processing and recovery operation, if the desired final characteristics of the sludge mixture change for any reason, the apparatus is easily adapted to accommodate the modification. In this way, the versatile recovery and processing apparatus of the invention may be configured differently and achieve different end results depending on the make-up of the raw sludge and the desired end use.

In a preferred embodiment, at least one or as many as all of the individual components or tanks of the processing apparatus is provided with a depth measurement device and an inlet shut-off switch that is activated should the material within the tank or processing unit exceed a predetermined level. In addition, the system may be provided with flow measuring equipment which monitors the quantity of cutter stock or other diluent which is added, as well as the total flow of processed sludge or blend stock at various stages of processing.

In an additional embodiment, heating elements and/or temperature monitors are provided within the system at specific locations. Heat may be needed to increase the efficiency of the processing action. Heat may also be needed in cases where lower external operating temperatures effectively cool the material while it is being processed. The necessity for heat will vary according to a number of factors, including such things as, the temperature of the operating environment, the makeup of the raw sludge, the type of and amount of diluent mixed with the sludge, the chemical constituency of the blend, and the amount of moisture in the sludge.

The flow of the sludge mixture through the system can be controlled either manually or automatically. If the control is automatic, it is contemplated that the system will be provided with a means to manually override the automatic control in the event the operator determines a change in the treatment parameters is warranted.

The system may also include one or more sifting screens and/or magnetic field generators upstream from the high shear mixer which will act to separate large or ferrous objects which would damage the processing components of the mixer.

It is highly desirable that substantially complete recovery of the fuel value contained in the raw sludge be achieved. In a preferred embodiment, substantially complete recovery is accomplished by adding the final processed sludge end product usually, e.g. 1–20%, preferably 5–10% by total weight of the mixture, to a commercial fuel product.

The processed sludge mixture would thus form a blend stock. Commercial fuels are regulated by set standards which set forth minimum requirements which the fuel must meet in order to be sold to consumers as a particular type of fuel. These standards are set by many regulatory agencies such as the U.S. Environmental Protection Agency, state environmental departments, and local municipal agencies, which relate primarily to the maximum content of certain residual combustion effluents which are permitted in a burned fuel.

In a preferred embodiment, the processed sludge end product blend stock is added directly to a commercial fuel product such that the regulatory minimum standards which are set for the geographical area and combustion effluent where the fuel, diluted by the blend stock, is being burned, will not be exceeded. Since the processed sludge blend stock is added without any filtration or separation, the fuel value which is present in the extracted sludge will be substantially completely recovered. Alternately, the processed sludge blend stock could be transferred via pipes or by tankers to other locations either within a refinery or to other sites for further processing or use.

In some cases, the blend stock will have to go through a moisture reduction process such as a centrifuge, if the moisture content exceeds acceptable limits.

The following example is intended as further illustration of the invention and is not to be construed as limiting.

EXAMPLE 1000 barrels of raw crude oil sludge is recovered from the bottom of a crude oil storage tank with the recovery unit of the invention. 300 barrels of #2 diesel fuel, as cutter stock, are added during extraction with the recovery unit described above, and a total of 1300 barrels of liquified raw sludge are extracted and transferred out of the storage tank to the processor consisting of the high shear mixers and intermediate storage tanks. The high shear mixers employed are Silverson In-Line LS mixers. The machines operate at 3600 RPM and the sludge mixture is fed through the high shear mixer at a rate of 400 gallons per minute. The average size of particles after processing ranges from 3 to 15 microns. The mixer passes through 2 stages of high shear processing, and the resultant blend has in excess of 13,000 BTU per pound and has a sulfur content of less than 1%. The blend stock is added to #6 fuel oil in an amount equal to 5% by total weight of the mixture.

What is claimed is:

1. Apparatus for recovering crude oil sludge contained in an oil storage tank bottom comprising:

a mobile extraction unit capable of being inserted into a storage tank, said extraction unit comprising a tracked carriage;

an extraction pump mounted on said tracked carriage;

at least one powered cutting tool mounted on said tracked carriage in a position in front of said extraction pump, said cutting tool being powered independently of said tracked carriage and said extraction pump; and at least one injector provided on said extraction unit, said injector being capable of injecting cutter stock such that said cutter stock will act to entrain said crude oil sludge, forming a sludge mixture;

a hose removably connected at its inlet end to said mobile extraction unit and adapted to accommodate and transport said sludge mixture recovered by said extraction unit from said storage tank;

a comminution chamber in fluid communication with the outlet end of said hose and adapted to receive said sludge mixture which is transported by said hose, said comminution chamber including therein a means to reduce the particle size of solid particles contained within said sludge mixture; and an outlet in fluid communication with said comminution chamber for blend stock product.

2. The apparatus of claim 1 which further comprises at least one diluent injection port which is connected to and in fluid communication with said comminution chamber, said at least one injection port being adapted to controllably inject a variable quantity of diluent into said sludge mixture.

3. The apparatus of in claim 2, wherein said at least one injection port is provided adjacent said powered cutting tool.

4. The apparatus of claim 1, wherein said mobile extraction unit further comprises a closed circuit camera to monitor and locate said extraction unit within said oil storage tank.

5. The apparatus of claim 1, wherein said tracked carriage is remotely controlled.

6. The apparatus of claim 1, wherein said extraction pump is hydraulically actuated.

7. The apparatus of claim 1, wherein said powered cutting tool is a helical auger.

8. The apparatus of claim 1, wherein said tracked carriage is provided with two continuous track members, said continuous track members being pivotal to render said mobile extraction unit capable of being inserted into said storage tank.

9. The apparatus of claim 8, wherein said mobile extraction unit is provided with two powered cutting tools, said powered cutting tools comprising helical augers which are mounted in front of and adjacent to said continuous track members.

10. The apparatus of claim 1, which further comprises a control unit, said control unit being capable of remotely controlling independent operation of said tracked carriage, said extraction pump, said at least one powered cutting tool, and said at least one injector, which are provided on said extraction unit.

11. The apparatus of claim 1, wherein said comminution chamber comprises a high shear mixing device.

12. The apparatus of claim 11, wherein said high shear mixing device includes an interchangeable workhead, said workhead being provided with a plurality of apertures formed therein such that when said workhead is subjected to high speed rotation, solid particles in the vicinity of said workhead will be forced through said apertures so as to reduce the mean particle size of said solid particles.

13. The apparatus of claim 1, further comprising at least one intermediate reservoir which is in fluid communication with said comminution chamber.

* * * * *